US006930572B2

(12) United States Patent
Rawnick et al.

(10) Patent No.: US 6,930,572 B2
(45) **Date of Patent: *Aug. 16, 2005**

(54) CONTINUOUSLY TUNABLE RESONANT CAVITY

(75) Inventors: James J. Rawnick, Palm Bay, FL (US); Stephen B. Brown, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 65 days.

This patent is subject to a terminal disclaimer.

(21) Appl. No.: 10/635,629

(22) Filed: Aug. 6, 2003

(65) Prior Publication Data

US 2005/0030133 A1 Feb. 10, 2005

(51) Int. Cl.[7] ..... H01P 7/06
(52) U.S. Cl. ..... 333/231; 333/202
(58) Field of Search ..... 333/202, 209, 333/211, 227, 231, 232

(56) References Cited

U.S. PATENT DOCUMENTS 5,162,972 A 11/1992 Gripshover et al.
6,060,966 A * 5/2000 Tennant et al. ..... 333/202
6,515,235 B2 2/2003 Moller

OTHER PUBLICATIONS

U.S. Appl. No. 10/369,436, filed Feb. 18, 2003, Rawnick et al.
U.S. Appl. No. 10/387,208, filed Mar. 11, 2003, Rawnick et al.
U.S. Appl. No. 10/330,755, filed Dec. 27, 2002, Rawnick et al.
U.S. Appl. No. 10/330,754, filed Dec. 27, 2002, Rawnick et al.
U.S. Appl. No. 10/300,456, filed Nov. 19, 2002, Rawnick et al.
U.S. Appl. No. 10/361,548, filed Feb. 10, 2003, Rawnick et al.
U.S. Appl. No. 10/387,209, filed Mar. 11, 2003, Rawnick et al.
U.S. Appl. No. 10/439,094, filed May 15, 2003, Rawnick et al.
U.S. Appl. No. 10/387,194, filed Mar 11, 2003, Brown et al.
U.S. Appl. No. 10/438,435, filed May 15, 2003, Brown et al.
U.S. Appl. No. 10/414,696, filed Apr. 16, 2003, Brown et al.
U.S. Appl. No. 10/637,027, filed Aug. 7, 2003, Brown et al.
U.S. Appl. No. 10/414,650, filed Apr. 16, 2003, Brown et al.
U.S. Appl. No. 10/459,067, filed Jun. 11, 2003, Brown et al.
U. S. Appl. No. 10/438,436, filed May 15, 2003, Rawnick et al.
U.S. Appl. No. 10/626,090, filed Jul. 24, 2003, Brown et al.
U.S. Appl. No. 10/635,582, filed Aug. 6, 2003, Rawnick et al.
U.S. Appl. No. 10/632,632, filed Aug. 1, 2003, Rawnick et al.

(Continued)

*Primary Examiner*—Stephen E. Jones
(74) *Attorney, Agent, or Firm*—Sacco & Associates, PA

(57) ABSTRACT

A tunable resonant system comprising a resonant cavity apparatus including at least one cavity wall (150, 151, 152, 153, 154, 155) made of a conductive material and arranged to form a resonant cavity (102), and a method for varying the resonant characteristics of the tuned resonant cavity (102). The conductive material can be steel, brass, copper, ferrite and/or Iron-nickel alloy. At least one slot (104) can be provided in a wall (150, 151, 152, 153, 154, 155) of the resonant cavity for coupling energy in and out of the resonant cavity. A fluidic dielectric (108) is disposed within the resonant cavity (102). A fluid control system (101) can be provided for selectively varying a composition of the fluidic dielectric (108) to dynamically modify a frequency response of the resonant cavity (102).

20 Claims, 3 Drawing Sheets

OTHER PUBLICATIONS

U.S. Appl. No. 10/614,149, filed Jul. 7, 2003, Brown et al.
U.S. Appl. No. 10/634,219, filed Aug. 5, 2003, Rawnick et al.
U.S. Appl. No. 10/458,859, filed Jun. 11, 2003, Rawnick et al.
U.S. Appl. No. 10/624,378, filed Jul. 22, 2003, Brown et al.
U.S. Appl. No. 10/438,433, filed May 15, 2003, Rawnick et al.
U.S. Appl. No. 10/460,947, filed Jun. 13, 2003, Rawnick et al.
U.S. Appl. No. 10/421,352, filed Apr. 23, 2003, Rawnick et al.
U.S. Appl. No. 10/409,261, filed Apr. 8, 2003, Pike.
U.S. Appl. No. 10/441,743, filed May 19, 2003, Pike.
U.S. Appl. No. 10/628,846, filed Jul. 28, 2003, Pike et al.
U.S. Appl. No. 10/448,973, filed May 30, 2003, Delgado et al.
U.S. Appl. No. 10/300,455, filed Nov. 19, 2002, Brown et al.
Karl M. Strohm, Franz Josef Schumuckle, Bernd Schauwecker, Johann–Friedrich Luy, Wolfgang Heinrich, "*Silicon Micromachined RF MEMS Resonators*", 2002 IEEE MTT–S CDROM; pp. 1209–1212.

Integrated Publishing website. "Cavity Resonators" <<http://www.tpub.com/neets/book11/44m.htm>>Nov. 25, 2002.

C.J. Reddy, M.D. Deshpande, D.T. Fralick, "*Analysis of Elliptically Polarized Cavity Backed Antennas Using a Combined FEM/MoM/GTD Technique*", National Aeronautics and Space Administration Contractor Report 198197, Aug., 1995.

K.W. Leung, K.Y. Chow, "*Theory and Experiment of the Hemispherical Cavity–Backed Slot Antenna*", IEEE Transactions of Antennas and Propagation, VO. 46, No. 8, Aug. 1998.

Kut Yuen Chow, Kwok Wa Leung, "*Theory and Experiment of the Cavity–Backed Slot–Excited Dielectric Resonator Antenna*", IEEE Transactions on Electromagnetic Compatibility, VO. 42, No. 3, Aug., 2000.

* cited by examiner

CONTINUOUSLY TUNABLE RESONANT CAVITY

BACKGROUND OF THE INVENTION

1. Statement of the Technical Field

The inventive arrangements relate generally to methods and apparatus for providing increased design flexibility for RF circuits and, more particularly, to resonant cavities.

2. Description of the Related Art

Resonant cavities are well known radio frequency (RF) devices and are commonly used in a variety of RF circuits, for example, in conjunction with microwave antennas and local oscillators. Resonant cavities are typically completely enclosed by conducting walls that can contain oscillating electromagnetic fields. A slot is generally provided in one of the resonant cavity walls through which RF energy can be transmitted into, and extracted from, the resonant cavity. Resonant cavities can be constructed with a variety of shapes and can be used for different applications and frequency ranges. Nonetheless, the basic principles of operation are the same for all resonant cavities.

A resonant cavity resonates at frequencies which are determined by the dimensions of the resonant cavity. As the cavity dimensions increase, the resonant frequencies tend to decrease, and vice versa. For example, the lowest resonant frequency of a three dimensional rectangular resonant cavity is given by the equation:

$$f = \frac{C_0\sqrt{\frac{1}{a^2}+\frac{1}{b^2}}}{2\sqrt{\mu_r\varepsilon_r}}$$

where a and b the two largest dimensions of the cavity (i.e. length and width), $\in_r$ is the relative permittivity of the dielectric within the resonant cavity, $\mu_r$ is the relative permeability of the resonant cavity, and $C_0$ is the speed of light.

Resonant cavities provide many advantages for RF circuits operating in the microwave frequency range. In particular, resonant cavities have a very high quality factor (Q). In fact, cavities with a Q value in excess of 30,000 are not uncommon. The high Q gives resonant cavities an extremely narrow bandpass, which enables very precise operation of microwave devices utilizing the resonant cavities. In consequence to the narrow bandpass, however, resonant cavities are typically limited to operating only at very specific frequencies.

SUMMARY OF THE INVENTION

The present invention relates to a tunable resonant system, and a method for varying the resonant characteristics of the tuned resonant cavity. The tunable resonant system includes a resonant cavity apparatus, which has at least one cavity wall made of a conductive material and arranged to form a resonant cavity. The cavity wall can be, for example, steel, brass, copper, ferrite and/or Iron-nickel alloy. At least one slot can be provided in the cavity wall for coupling energy in and out of the resonant cavity.

A fluidic dielectric is disposed within the resonant cavity. A fluid control system can be provided for selectively varying a composition of the fluidic dielectric to dynamically modify a frequency response of the resonant cavity. For example, a relative permittivity, relative permeability and/or loss tangent of the fluidic dielectric can be varied. The frequency response can be a center frequency, a bandwidth, a quality factor (Q), and/or an impedance of the resonant cavity. Further, the composition of the fluidic dielectric can be modified to maintain constant at least one frequency response parameter when a second frequency response parameter is varied, or to compensate for any mechanical variations in the resonant cavity.

The fluid control system can further include a composition processor for dynamically mixing together a plurality of component parts to form the fluidic dielectric. For example, the component parts can be selected from the group consisting of (a) a low permittivity, low permeability component, (b) a high permittivity, low permeability component, and (c) a high permittivity, high permeability component.

DETAILED DESCRIPTION OF THE PREFERRED EMBODIMENTS

The present invention relates to a continuously variable resonant system. The invention provides the circuit designer with an added level of flexibility by permitting a fluidic dielectric to be used in a tuned resonant cavity (resonant cavity), thereby enabling the dielectric properties within the resonant cavity to be varied. Since group velocity in a medium is inversely proportional to $\sqrt{\mu\in}$, increasing the permittivity ($\in$) and/or permeability ($\mu$) in the dielectric decreases group velocity of an electromagnetic field within a resonant cavity, and thus the signal wavelength. Accordingly, electrical characteristics of the fluidic dielectric can be selected to decrease the physical size of a resonant cavity and to tune the operational characteristics of the resonant cavity. For example, the permittivity and/or permeability can be adjusted to tune the center frequency of cavity resonances. Further, the loss tangent of the fluidic dielectric can be adjusted in addition to the permittivity and/or permeability in order to tune additional operational parameters, for instance, the quality factor (Q), bandwidth of resonances within the resonant cavity, and an impedance of the resonant cavity. Accordingly, a resonant cavity of a given size can be used for a broad range of frequencies and applications without altering the physical dimensions of the resonant cavity. Moreover, if the physical dimensions of the resonant cavity change, for example due to thermal expansion or contraction, during operation of the resonant cavity, the permittivity, permeability and/or loss tangent of the fluidic dielectric can be automatically adjusted to keep the resonant cavity tuned for optimum performance. Importantly, the present invention eliminates the need for manual adjustments, such as tuning screws, to keep the resonant cavity properly tuned.

Figure 1A:
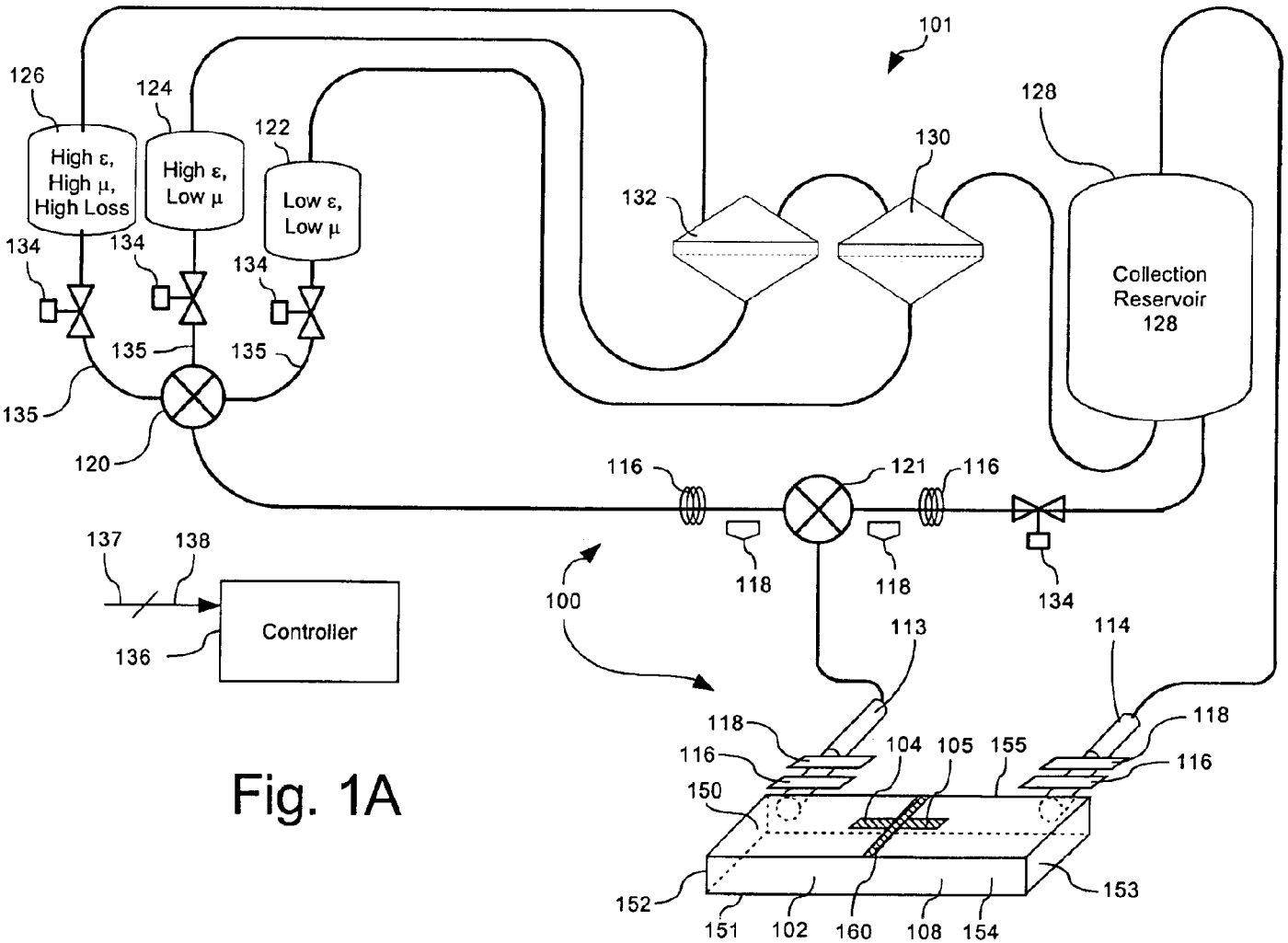
FIG. 1A is a conceptual diagram useful for understanding the continuously variable resonant cavity in accordance with the present invention.
Figure 1B:
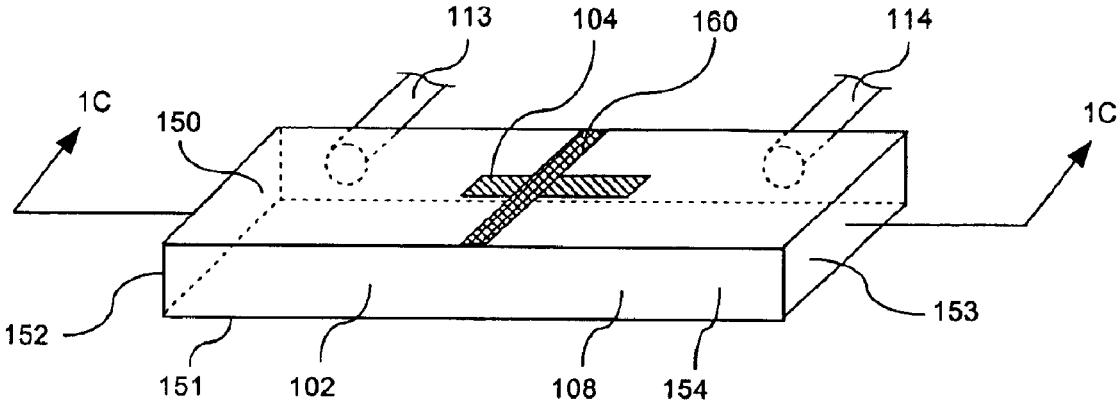
FIG. 1B is an enlarged view of the continuously variable resonant cavity of FIG. 1A.

FIG. 1A is a conceptual diagram that is useful for understanding the continuously variable resonant cavity of the present invention. The resonant cavity apparatus 100 includes a resonant cavity 102, which is shown in an enlarged view in FIG. 1B. The resonant cavity 102 can be a cavity enclosed by an electrically or magnetically conductive material, for instance cavity walls 150, 151; 152, 153; 154, 155. The cavity walls can be fabricated from any material that can be used to construct a resonant cavity. For example, the cavity walls can be fabricated steel, brass, copper, ferrite, Iron-nickel alloy, etc. Further, the resonant cavity 102 can have a pre-determined geometry and can be at least partially filled with a fluidic dielectric 108. A slot 104, or aperture, can be provided in a cavity wall 150 for coupling RF signals to the resonant cavity, for example RF signals propagating in a circuit device. An input conduit 113 and an output conduit 114 can be provided for circulating the fluidic dielectric 108 through the resonant cavity 102.

The continuously variable resonant cavity 102 can be used in any circuit that can include any other type of resonant cavity. For example, the resonant cavity 102 can be used in conjunction with an antenna element 160. The resonant cavity 102 also can be used with other circuit devices, for example an oscillator or a filter. Moreover, the resonant cavity 102 can be used as a filter element. Still, there are many other applications where the resonant cavity 102 can be used, and such applications are understood to be within the scope of the present invention.

Figure 1C:
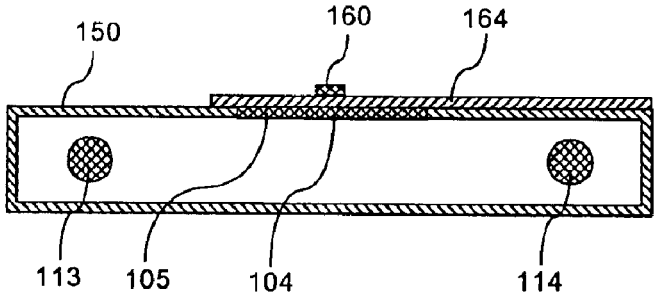
FIG. 1C is a sectional view of the continuously variable resonant cavity of FIG. 1B.

A sectional view of the resonant cavity 102 is shown in FIG. 1C. The input conduit 113 and the output conduit 114 can be directly coupled to the resonant cavity 102. The antenna element 160 can be disposed on cavity wall 150 which, as noted, can be conductive. A dielectric insulator 164 can be positioned between the antenna element 160 and the cavity wall 150 to insulate the antenna element 160 from the cavity wall 150.

The fluidic dielectric 108 can be constrained within the resonant cavity 102. A dielectric barrier 105 can be placed in the slot 104 to prevent leakage of the fluidic dielectric 108 from the resonant cavity 102. The dielectric barrier 105 can be glass, plastic, or any other dielectric material which is impermeable to the fluidic dielectric 108. Accordingly, the dielectric barrier 105 will maintain the fluidic dielectric 108 within the resonant cavity 102, while having an insignificant impact on resonant cavity performance. In one arrangement, the dielectric insulator 164 can be disposed over the slot 104 to prevent leakage of the fluidic dielectric 108. This arrangement can be used in lieu of the dielectric barrier 105.

Referring again to FIG. 1A, a fluid control system including a fluid composition processor 101 is provided for changing a composition of the fluidic dielectric 108 to vary its permittivity, permeability and/or loss tangent. A controller 136 controls the composition processor for selectively varying the permittivity and/or permeability of the fluidic dielectric 108 in response to a resonant system control signal 137. By selectively varying the permittivity and/or permeability of the fluidic dielectric, the controller 136 can control group velocity and phase velocity of an RF signal within the resonant cavity 102, and thus resonances within the resonant cavity 102. The permittivity and/or permeability also can be adjusted to control the impedance of the resonant cavity. By selectively varying the loss tangent of the fluidic dielectric along with the permittivity and/or permeability, the controller 136 can control the Q and bandwidth of the resonant cavity 102.

In particular, the center frequencies at which the resonant cavity 102 resonates are determined by the dimensions of the resonant cavity, for example the distance between opposing walls 150, 151; 152, 153; 154, 155. A change in permittivity and/or permeability, which results in a change in phase velocity and group velocity of a signal within a resonant cavity, effectively changes the relative dimensions of the resonant cavity with respect to signal wavelength. Accordingly, the controller 136 can control the center frequencies of the cavity resonances by adjusting the permittivity and/or permeability of the fluidic dielectric 108. For instance, the permittivity and/or permeability of the fluidic dielectric 108 can be increased to result in a lower group velocity, which will cause the center frequencies to decrease. Likewise, a decrease in permittivity and/or permeability can increase the center frequencies. Additionally, the permittivity and/or permeability also can be adjusted to tune the impedance of the resonant cavity, which is beneficial for optimizing the RF coupling between the resonant cavity 102 and a circuit element, such as the antenna element 160.

Moreover, the permittivity and/or permeability can be adjusted to maintain a resonant frequency of the resonant cavity 102 constant. For instance, the permittivity and/or permeability can be adjusted to compensate for thermal expansion and contraction of the resonant cavity, such as when a resonant cavity is exposed to temperature extremes or when a substantial amount of power loss occurs in the resonant cavity. Such power loss can occur in a resonant cavity which is used in high power microwave transmission applications.

Further, since loss tangent and Q are inversely proportional, the loss tangent of the fluidic dielectric 108 can be increased to lower the Q and increase the bandwidth of a resonance of the resonant cavity 102. A decrease in the loss tangent can increase the Q and lower the bandwidth of the resonant cavity 102 resonance.

Composition of Fluidic Dielectric

The fluidic dielectric can be comprised of several component parts that can be mixed together to produce a desired permittivity and permeability required for a particular group velocity and resonant cavity resonant frequencies. In this regard, it will be readily appreciated that fluid miscibility and particle suspension are key considerations to ensure proper mixing. Another key consideration is the relative ease by which the component parts can be subsequently separated from one another. The ability to separate the component parts is important when the operational frequency, bandwidth or Q change. Specifically, this feature ensures that the component parts can be subsequently re-mixed in a different proportion to form a new fluidic dielectric.

Many applications also require resonant cavities to be tunable over a wide frequency range. Accordingly, it may be desirable in many instances to select component mixtures that produce a fluidic dielectric that has a relatively constant response over a broad range of frequencies. If the fluidic dielectric is not relatively constant over a broad range of frequencies, the characteristics of the fluid at various frequencies can be accounted for when the fluidic dielectric is mixed. For example, a table of permittivity, permeability and loss tangent values vs. frequency can be stored in the controller 136 for reference during the mixing process.

Aside from the foregoing constraints, there are relatively few limits on the range of component parts that can be used to form the fluidic dielectric. Accordingly, those skilled in the art will recognize that the examples of component parts, mixing methods and separation methods as shall be disclosed herein are merely by way of example and are not intended to limit in any way the scope of the invention. Also, the component materials are described herein as being mixed in order to produce the fluidic dielectric. However, it should be noted that the invention is not so limited. Instead, it should be recognized that the composition of the fluidic dielectric could be modified in other ways. For example, the component parts could be selected to chemically react with one another in such a way as to produce the fluidic dielectric with the desired values of permittivity and/or permeability. All such techniques will be understood to be included to the extent that it is stated that the composition of the fluidic dielectric is changed.

A nominal value of permittivity ($\in_r$) for fluids is approximately 2.0. However, the component parts for the fluidic dielectric can include fluids with extreme values of permittivity. Consequently, a mixture of such component parts can be used to produce a wide range of intermediate permittivity values. For example, component fluids could be selected with permittivity values of approximately 2.0 and about 58 to produce a fluidic dielectric with a permittivity anywhere within that range after mixing. Dielectric particle suspensions can also be used to increase permittivity.

According to a preferred embodiment, the component parts of the fluidic dielectric can be selected to include (a) a low permittivity, low permeability, low loss component, (b) a high permittivity, low permeability, low loss component and (c) a high permittivity, high permeability, high loss component. These three components can be mixed as needed for increasing the permittivity while maintaining a relatively constant loss tangent and for increasing the loss tangent while maintaining a relatively constant product of permittivity and permeability. Still, a myriad of other component mixtures can be used. For example, the following fluidic dielectric components can be provided: (a) a low permittivity, low permeability, low loss component, (b) a high permittivity, low permeability, low loss component, (c) a high permittivity, high permeability, low loss component, and (d) a low permittivity, low permeability, high loss component.

High levels of magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organo-metallic compounds, and other derivatives, although Fe and Co particles are most common. The size of the magnetic particles found in such systems is known to vary to some extent. However, particles sizes in the range of 1 nm to 20 $\mu$m are common. The composition of particles can be varied as necessary to achieve the required range of permeability in the final mixed fluidic dielectric after mixing. However, magnetic fluid compositions are typically between about 50% to 90% particles by weight. Increasing the number of particles will generally increase the permeability.

An example of a set of component parts that could be used to produce a fluidic dielectric as described herein would include oil (low permittivity, low permeability and low loss), a solvent (high permittivity, low permeability and low loss), and a magnetic fluid, such as combination of an oil and a ferrite (low permittivity, high permeability and high loss). Further, certain ferrofluids also can be used to introduce a high loss tangent into the fluidic dielectric, for example those commercially available from FerroTec Corporation of Nashua, N.H. 03060. In particular, Ferrotec part numbers EMG0805, EMG0807, and EMG1111 can be used. An example of a relatively low dielectric fluid with moderate to high loss is Lord MRF-132AD, which exhibits a dielectric constant between 5 and 6, and has a loss tangent approximately 5–6 times that of air.

A hydrocarbon dielectric oil such as Vacuum Pump Oil MSDS-12602 could be used to realize a low permittivity, low permeability, and low loss tangent fluid. A low permittivity, high permeability fluid may be realized by mixing the hydrocarbon fluid with magnetic particles or metal powders which are designed for use in ferrofluids and magnetoresrictive (MR) fluids. For example magnetite magnetic particles can be used. Magnetite is also commercially available from FerroTec Corporation. An exemplary metal powder that can be used is iron-nickel, which can be provided by Lord Corporation of Cary, N.C. Fluids containing electrically conductive magnetic particles require a mix ratio low enough to ensure that no electrical path can be created in the mixture. Additional ingredients such as surfactants can be included to promote uniform dispersion of the particles. High permittivity can be achieved by incorporating solvents such as formamide, which inherently posses a relatively high permittivity. Fluid permittivity also can be increased by adding high permittivity powders such as Barium Titanate manufactured by Ferro Corporation of Cleveland, Ohio. For broadband applications, the fluids would not have significant resonances over the frequency band of interest.

Processing of Fluidic Dielectric For Mixing/Unmixing of Components

The composition processor 101 can be comprised of a plurality of fluid reservoirs containing component parts of fluidic dielectric 108. These can include: a first fluid reservoir 122 for a low permittivity, low permeability component of the fluidic dielectric; a second fluid reservoir 124 for a high permittivity, low permeability component of the fluidic dielectric; a third fluid reservoir 126 for a high permittivity, high permeability, high loss component of the fluidic dielectric. Those skilled in the art will appreciate that other combinations of component parts may also be suitable and the invention is not intended to be limited to the specific combination of component parts described herein. For example, the third fluid reservoir 126 can contain a high permittivity, high permeability, low loss component of the fluidic dielectric and a fourth fluid reservoir can be provided to contain a component of the fluidic dielectric having a high loss tangent.

A cooperating set of proportional valves 134, mixing pumps 120, 121, and connecting conduits 135 can be provided as shown in FIG. 1A for selectively mixing and communicating the components of the fluidic dielectric 108 from the fluid reservoirs 122, 124, 126 to the resonant cavity 102. The composition processor also serves to separate out the component parts of fluidic dielectric 108 so that they can be subsequently re-used to form the fluidic dielectric with different attenuation, permittivity and/or permeability values. All of the various operating functions of the composition processor can be controlled by controller 136. The operation of the composition processor shall now be described in greater detail with reference to FIG. 1A and the flowchart shown in FIG. 2.

Figure 2:
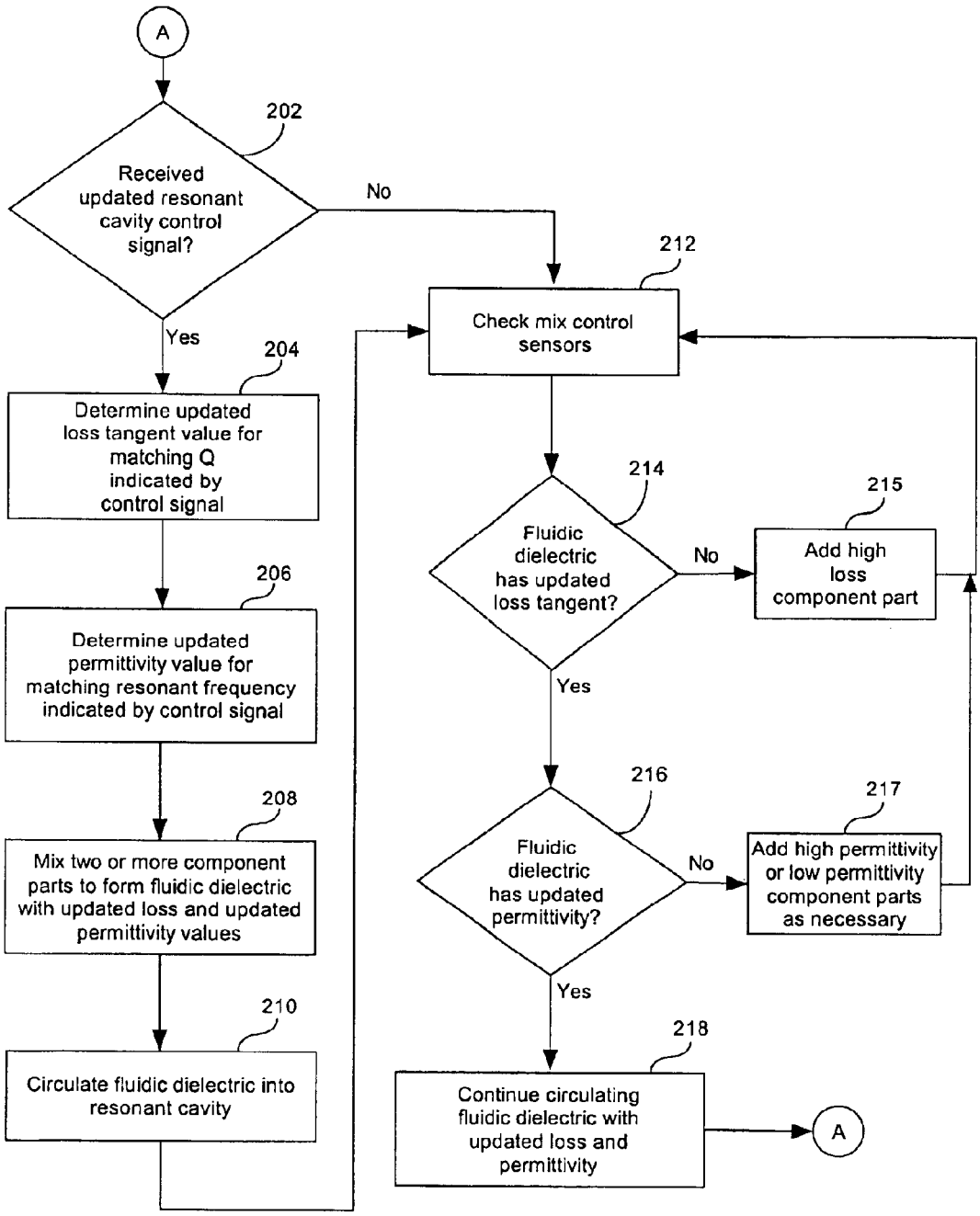
FIG. 2 is a flow chart that is useful for understanding the process of the invention.

The process can begin in step 202 of FIG. 2, with controller 136 checking to see if an updated resonant system control signal 137 has been received on a controller input line 138. If so, then the controller 136 continues on to step 204 to determine an updated loss tangent value for producing the Q indicated by the resonant system control signal 137. The updated loss tangent value necessary for achieving the indicated attenuation can be determined using a look-up table.

In step 206, the controller can determine an updated permittivity value for matching the resonant frequency indicated by the resonant system control signal 137. For example, the controller 136 can determine the permeability of the fluidic components based upon the fluidic component mix ratios and determine an amount of permittivity that is necessary to achieve the indicated impedance for the determined permeability.

Referring to step 208, the controller 136 causes the composition processor 101 to begin mixing two or more component parts in a proportion to form fluidic dielectric that has the updated loss tangent and permittivity values determined earlier. In the case that the high loss component part also provides a substantial portion of the permeability in the fluidic dielectric, the permeability will be a function of the amount of high loss component part that is required to achieve a specific attenuation. However, in the case that a separate high loss tangent fluid is provided as a high loss component part, the loss tangent can be determined independently of the permeability. This mixing process can be accomplished by any suitable means. For example, in FIG. 1A a set of proportional valves 134 and mixing pump 120 are used to mix component parts from reservoirs 122, 124, 126 appropriate to achieve the desired updated loss tangent, permittivity and permeability values.

In step 210, the controller causes the newly mixed fluidic dielectric 108 to be circulated into the resonant cavity 102 through a second mixing pump 121. In step 212, the controller checks one or more sensors 116, 118 to determine if the fluidic dielectric being circulated through the resonant cavity 102 has the proper values of loss tangent, permittivity and permeability. Sensors 116 are preferably inductive type sensors capable of measuring permeability. Sensors 118 are preferably capacitive type sensors capable of measuring permittivity. Further, sensors 116 and 118 can be used in conjunction to measure loss tangent. The loss tangent is a ratio between real and imaginary components of an impedance associated with the fluidic dielectric. As such, the loss tangent can be determined by measuring resistance or conductance of the fluidic dielectric to measure the real component of the impedance and by measuring inductance and/or capacitance associated with the fluidic dielectric to measure the imaginary component of the impedance. Additionally, loss tangent can be calculated using a separate resonator device, such as a dielectric ring resonator. Such a resonator device is commonly used to compute the Q of the fluidic dielectric, from which the loss tangent can be computed.

The sensors can be located as shown, at the input to mixing pump 121. Sensors 116, 118 are also preferably positioned to measure the loss tangent, permittivity and permeability of the fluidic dielectric passing through the input conduit 113 and the output conduit 114. Note that it is desirable to have a second set of sensors 116, 118 at or near the resonant cavity 102 so that the controller can determine when the fluidic dielectric with updated loss tangent, permittivity and permeability values has completely replaced any previously used fluidic dielectric that may have been present in the resonant cavity 102.

In step 214, the controller 136 compares the measured loss tangent to the desired updated loss tangent value determined in step 204. If the fluidic dielectric does not have the proper updated loss tangent value, the controller 136 can cause additional amounts of high loss tangent component part to be added to the mix from reservoir 126, as shown in step 215.

If the fluidic dielectric is determined to have the proper level of loss in step 214, then the process continues on to step 216 where the measured permittivity from step 212 is compared to the desired updated permittivity value determined in step 206. If the updated permittivity value has not been achieved, then high or low permittivity component parts are added as necessary, as shown in step 217. The system can continue circulating the fluidic dielectric through the resonant cavity 102 until both the loss tangent and permittivity passing into and out of the resonant cavity 102 are the proper value, as shown in step 218. Once the loss tangent and permittivity are the proper value, the process can continue to step 202 to wait for the next updated resonant cavity control signal.

Significantly, when updated fluidic dielectric is required, any existing fluidic dielectric must be circulated out of the resonant cavity 102. Any existing fluidic dielectric not having the proper loss tangent and/or permittivity can be deposited in a collection reservoir 128. The fluidic dielectric deposited in the collection reservoir 128 can thereafter be re-used directly as a fourth fluid by mixing with the first, second and third fluids or separated out into its component parts so that it may be re-used at a later time to produce additional fluidic dielectric. The aforementioned approach includes a method for sensing the properties of the collected fluid mixture to allow the fluid processor to appropriately mix the desired composition, and thereby, allowing a reduced volume of separation processing to be required. For example, the component parts can be selected to include a first fluid made of a high permittivity solvent completely miscible with a second fluid made of a low permittivity oil that has a significantly different boiling point. A third fluid component can be comprised of a ferrite particle suspension in a low permittivity oil identical to the first fluid such that the first and second fluids do not form azeotropes. Given the foregoing, the following process may be used to separate the component parts.

A first stage separation process would utilize distillation system 130 to selectively remove the first fluid from the mixture by the controlled application of heat thereby evaporating the first fluid, transporting the gas phase to a physically separate condensing surface whose temperature is maintained below the boiling point of the first fluid, and collecting the liquid condensate for transfer to the first fluid reservoir. A second stage process would introduce the mixture, free of the first fluid, into a chamber 132 that includes an electromagnet that can be selectively energized to attract and hold the paramagnetic particles while allowing the pure second fluid to pass which is then diverted to the second fluid reservoir. Upon de-energizing the electromagnet, the third fluid would be recovered by allowing the previously trapped magnetic particles to combine with the fluid exiting the first stage which is then diverted to the third fluid reservoir.

Those skilled in the art will recognize that the specific process used to separate the component parts from one another will depend largely upon the properties of materials that are selected and the invention. Accordingly, the invention is not intended to be limited to the particular process outlined above.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A tunable resonant system, comprising:

a resonant cavity apparatus including at least one cavity wall made of a conductive material and arranged to form a resonant cavity;

a fluidic dielectric disposed within said resonant cavity; and a fluid control system for selectively varying a composition of said fluidic dielectric to dynamically modify a frequency response of said resonant cavity.

2. The tunable resonant system according to claim 1 further comprising at least one slot located in said at least one cavity wall for coupling energy into and out of said resonant cavity.

3. The tunable resonant system according to claim 1 wherein said fluid control system varies said composition to modify at least one electrical characteristic of said fluidic dielectric.

4. The tunable resonant system according to claim 3 wherein said electrical characteristic is selected from the group consisting of a relative permittivity, a relative permeability and a loss tangent.

5. The tunable resonant system according to claim 4 wherein said frequency response is modified to vary at least one of a center frequency, a bandwidth, a quality factor (Q) and an impedance of said resonant cavity.

6. The tunable resonant system according to claim 1 wherein said fluid control system selectively varies said composition of said fluidic dielectric to maintain constant at least one parameter of said frequency response when a second parameter of said frequency response is varied.

7. The tunable resonant system according to claim 1 wherein said fluid control system selectively varies said composition of said fluidic dielectric to compensate for mechanical variations of said resonant cavity.

8. The tunable resonant system according to claim 1 wherein said conductive material is comprised of a material selected from the group consisting of steel, brass, copper, ferrite, and iron-nickel alloy.

9. The tunable resonant system according to claim 1 wherein said fluid control system further comprises a composition processor for dynamically mixing together a plurality of component parts to form said fluidic dielectric.

10. The tunable resonant system according to claim 9 wherein said component parts are selected from the group consisting of (a) a low permittivity, low permeability component, (b) a high permittivity, low permeability component, and (c) a high permittivity, high permeability component.

11. A method for dynamically controlling a frequency response of a resonant cavity comprising the steps of:

producing a first frequency response for said resonant cavity by disposing within said resonant cavity a fluidic dielectric; and selectively modifying a composition of said fluidic dielectric in response to a control signal to produce a second frequency response different from said first frequency response.

12. The method according to claim 11 further comprising the step of coupling RF energy into and out of said resonant cavity.

13. The method according to claim 11 further comprising the step of varying said composition to modify at least one electrical characteristic of said fluidic dielectric.

14. The method according to claim 13 further comprising the step of selecting said electrical characteristic from the group consisting of a relative permittivity, a relative permeability and a loss tangent.

15. The method according to claim 14 further comprising the step of modifying said frequency response to vary at least one of a center frequency, a bandwidth, a quality factor (Q) and an impedance of said resonant cavity.

16. The method according to claim 11 further comprising the step of selectively automatically varying said composition to maintain constant at least one parameter of said frequency response when a second parameter of said frequency response is varied.

17. The method according to claim 11 further comprising the step of automatically varying said composition of said fluidic dielectric to compensate for mechanical variations of said resonant cavity.

18. The method according to claim 11 further comprising the step of selecting a material for said conductive boundary walls selected from the group consisting of steel, brass, copper, ferrite, and iron-nickel alloy.

19. The method according to claim 11 further comprising the step of dynamically mixing together a plurality of component parts to form said fluidic dielectric.

20. The method according to claim 19 wherein said component parts are selected from the group consisting of (a) a low permittivity, low permeability component, (b) a high permittivity, low permeability component, and (c) a high permittivity, high permeability component.

* * * * *